US006454369B1

(12) United States Patent
Cooper et al.

(10) Patent No.: US 6,454,369 B1
(45) **Date of Patent: *Sep. 24, 2002**

(54) PULL-OUT KEYBOARD TRAY

(75) Inventors: Mark J. Cooper, Reseda; Kristin M. Stewart, Redondo Beach, both of CA (US)

(73) Assignee: Accuride International, Inc., Santa Fe Springs, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/305,353

(22) Filed: May 4, 1999

(51) Int. Cl.[7] ..... A47B 81/00; A47B 57/00

(52) U.S. Cl. ..... 312/223.3; 248/918; 312/334.44; 108/5; 108/143

(58) Field of Search ..... 248/346.01, 281.11, 248/918, 286.1, 287.1, 921, 922; 108/93, 143, 137, 5, 6, 96, 50.01, 50.02; 312/223.3, 208.1; 400/715, 717

(56) References Cited

U.S. PATENT DOCUMENTS

| | | | | | |
|---|---|---|---|---|---|
| 2,535,743 | A | * | 12/1950 | Lundahl | 400/717 |
| 4,616,798 | A | | 10/1986 | Smeenge et al. | 248/281.1 |
| 4,706,919 | A | | 11/1987 | Soberalski et al. | 248/281.1 |
| 4,735,466 | A | | 4/1988 | Wolters et al. | 312/24 |
| 4,736,689 | A | * | 4/1988 | Stanko | 108/143 |
| 4,901,972 | A | | 2/1990 | Judd et al. | 248/918 |
| 4,986,616 | A | | 1/1991 | Chang et al. | 312/208 |
| 4,988,066 | A | | 1/1991 | Cotterill | 248/281.1 |
| 5,031,867 | A | | 7/1991 | Cotterill | 248/281.1 |
| 5,037,054 | A | | 8/1991 | McConnell | 248/284 |
| 5,040,757 | A | * | 8/1991 | Benaway | 400/715 |
| 5,062,609 | A | * | 11/1991 | Hames et al. | 248/918 |

(List continued on next page.)

FOREIGN PATENT DOCUMENTS

| | | |
|---|---|---|
| WO | WO 85/02524 | 6/1985 |

*Primary Examiner*—Leslie A. Braun
*Assistant Examiner*—Jon Szumny
(74) *Attorney, Agent, or Firm*—Christie, Parker & Hale, LLP

(57) ABSTRACT

A pull-out keyboard tray. The pull-out keyboard tray includes an adjustable keyboard platform, removable storage compartments, and keyboard wiring protrusions. The keyboard is slightly mounted on drawer slides having multiple position detents, and is adapted for mounting under a desk top surface and the like. The keyboard further includes a removable palmrest, as well as slide shrouds for shrouding the drawer slides.

7 Claims, 21 Drawing Sheets

U.S. PATENT DOCUMENTS 5,096,074 A * 3/1992 Merl ..... 211/175
5,098,053 A 3/1992 Coterill ..... 248/281.1
5,145,136 A 9/1992 McConnell ..... 248/284
5,211,367 A 5/1993 Musculus ..... 248/279
5,230,289 A 7/1993 George et al. ..... 108/2
5,257,767 A 11/1993 McConnell ..... 248/284
5,265,735 A * 11/1993 Hassel et al. ..... 400/717
5,273,250 A * 12/1993 Pemberton et al. ..... 248/918
5,292,097 A 3/1994 Russell ..... 248/281.1
5,302,015 A 4/1994 Du Vall ..... 312/282
5,377,951 A * 1/1995 Johnson et al. ..... 248/639
5,443,237 A 8/1995 Stadtmauer ..... 248/441.1
5,483,898 A 1/1996 Seidl ..... 108/3
5,487,525 A * 1/1996 Drabczyk et al. ..... 248/918
5,490,466 A 2/1996 Diffrient ..... 108/96
5,509,628 A 4/1996 Noble ..... 248/118
5,513,579 A 5/1996 Allan ..... 108/93
5,513,824 A * 5/1996 Leavitt et al. ..... 248/918
5,582,375 A 12/1996 Martin ..... 248/118.3
5,588,375 A * 12/1996 Cotterill ..... 108/102
5,595,428 A 1/1997 Huang ..... 312/223.3
5,623,881 A * 4/1997 Huang ..... 108/50
5,626,323 A 5/1997 Lechman et al. ..... 248/286.1
5,628,482 A 5/1997 Iravantchi et al. ..... 248/118
5,641,369 A * 6/1997 Kirchhoff et al. ..... 156/73.1
5,655,743 A 8/1997 Gillis ..... 248/346.01
5,667,320 A 9/1997 Ambrose et al. ..... 400/472
5,671,988 A * 9/1997 O'Neill ..... 312/334.44
5,692,712 A 12/1997 Weinschenk, Jr. et al. .. 248/118
5,697,303 A 12/1997 Allan ..... 108/93
5,704,299 A 1/1998 Corpuz, Jr. et al. ..... 108/50
5,704,698 A 1/1998 Lin ..... 312/208.1
5,735,222 A 4/1998 Webb ..... 108/144
5,771,814 A 6/1998 Clausen ..... 108/93
5,775,657 A 7/1998 Hung ..... 248/289.11
5,803,416 A * 9/1998 Hanson et al. ..... 400/715
5,823,487 A * 10/1998 Kirchhoff et al. ..... 108/93
5,895,020 A * 4/1999 Danzyger et al. ..... 248/918
5,961,192 A * 10/1999 Bernart et al. ..... 312/223.3
6,036,288 A * 3/2000 Shih ..... 312/223.3

* cited by examiner

PULL-OUT KEYBOARD TRAY

BACKGROUND OF THE INVENTION

This invention relates generally to pull-out trays, and more particularly to under-surface mounted pull-out keyboard trays.

The use of personal computers is widespread both at the office and at home. Such widespread use of personal computers has presented challenges to furniture and furniture accessory designers and manufacturers. A primary challenge is that office and office type furniture must be adapted to meet the requirements imposed by such computer systems.

Computer systems require room for display monitors, computer units, and computer keyboards. Display monitors are often placed on a desktop surface. Likewise, computer units are often placed about the desk on the floor or in some other position. Computer keyboards, however, often pose special problems. Preferably, a keyboard is located slightly in front of a display monitor so that a user may easily type on the keyboard while examining the monitor. Thus, users often place keyboards on desk tops directly in front of a monitor. Placing the keyboard on the desktop, however, is often troublesome. Such placement of the keyboard takes up valuable desk space which the user may at times require for other purposes. In addition, desktops are often slightly higher than the height at which ergonomic typing preferably occurs.

Extendably mounting the keyboard underneath a desktop surface, therefore, is often done. Mounting the keyboard under the desktop frees up valuable desk space, as well as positions the keyboard at a height more conducive for typing. Unfortunately, many keyboard trays extend significantly below the desktop such that the keyboard and a tray holding the keyboard reduce the knee space available for a user. Moreover, many such trays provide no room for storage of small objects. Also, tray users may inadvertently injure themselves through contact, particularly of fingers, with the slides during movement. In addition, keyboards generally have associated wiring, and many such known keyboards provide no items for efficient routing of the associated wires. Further, easy yet simple methods of positioning many keyboards, both in terms of amount of extension and of angle of inclination of the keyboard, are often lacking.

SUMMARY OF THE INVENTION

The present invention therefore provides a pull-out keyboard tray assembly. The assembly is slidably extendable from a position substantially below a desk top surface to a position extending out from the desk top surface. The assembly comprises a substantially rectangular tray, the tray being defined by a forward edge, a rearward edge, and side edges interconnecting the forward and rearward edges. The assembly further comprises support means for supporting the tray, the support means including a substantially vertical surface having horizontal edge surfaces adapted to support an edge of the tray.

In one embodiment the invention comprises a pull-out keyboard tray assembly with a tray adapted to receive a keyboard. At least one slide is coupled to the tray, the slide having a range of travel. The range of travel of the slide is from retracted position to an extended position, with a partial extended position being between the retracted position and the extended position. In one embodiment the slide is a 34 extension slide, and in one embodiment the slide is a full extension slide. Further, in one embodiment the slide includes a detent at the partial extended position. In an additional embodiment the assembly includes a storage compartment at the rear of the tray, with the tray substantially extending from the desk top surface when the slide is in the partial extended position, but the storage compartment is substantially underneath the desk top surface when the slide is at the partial extended position. And yet another embodiment of the invention, the pull-out keyboard tray assembly comprises a pair of slides adapted for mounting to an underside of a desk top. A keyboard support is coupled to the slides. Protrusions extend upward from the keyboard support surface, with the protrusions adapted to maintain position of a wire. In one embodiment the protrusions extend from slide shrouds coupled to the keyboard support, the slide shrouds substantially enclosing portions of the slides adjacent the keyboard support. In yet further embodiments of the present invention, the assembly includes a palmrest removably coupled to a forward edge of the keyboard support. In one embodiment the palmrest comprises a gel material mounted to a substantially rigid support.

Many of the attendant features of this invention will be more readily appreciated as the same becomes better understood in a reference to the following detailed description considering connection with the accompanying drawings.

DETAILED DESCRIPTION OF THE INVENTION

Figure 1:
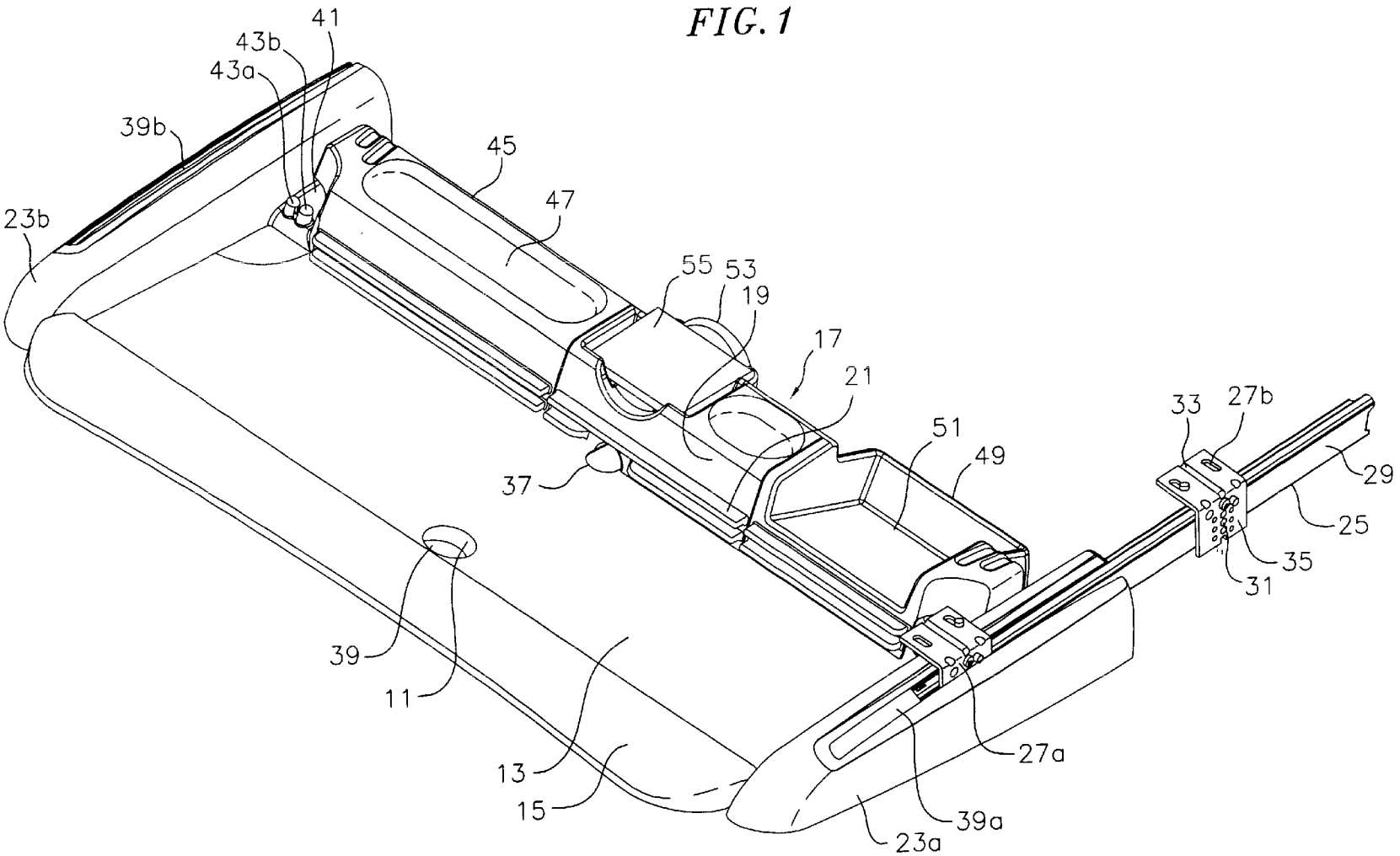
FIG. 1 is an isometric view of a pull-out keyboard tray of the present invention.

FIG. 1 illustrates a pull-out keyboard tray of the present invention. The keyboard tray includes a support tray 11 which undergirds a keyboard area. Partially resting on top of the support tray is a keyboard platform 13. The keyboard platform provides a surface upon which to place a keyboard. The keyboard platform is a generally flat planar surface substantially rectangular in shape. The sides of the support tray are bounded in the front by a palmrest 15, on the sides by slide shrouds 23*a, b*, and in the rear by a set of storage compartments 17. As used herein, references to directions such as front, rear, top, etc., are with reference to a keyboard positioned before a user, and the directions are used merely to more fully convey the description of the invention.

Figure 21:
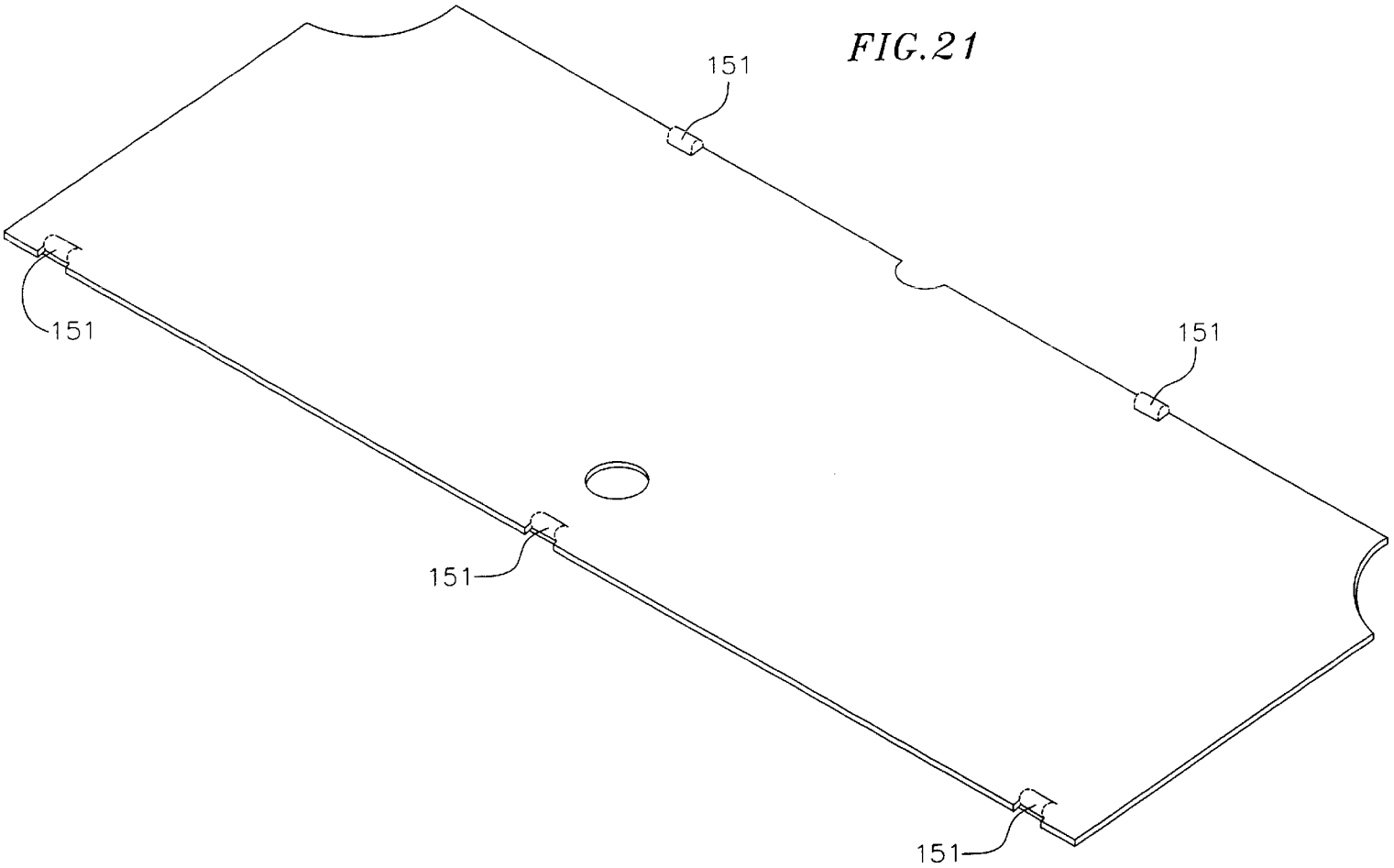
FIG. 21 is a view of the keyboard platform of FIG. 1.

The keyboard platform is illustrated in FIG. 21. The keyboard platform is a substantially flat, largely rectangular plate. As previously mentioned, the keyboard platform includes an aperture at its midpoint, as well as a notch along the rear edge. In the embodiment described the keyboard platform is steel, although in alternative embodiments the keyboard is aluminum or plastic.

The keyboard platform also includes polymeric grips 151 along the forward and rear edges. The polymeric grips, which are a soft polyurethane in one embodiment, have a substantially C-shaped cross-section. The grips are coupled to the keyboard platform along small notches (not shown), which allows the grips to engage the keyboard platform without extending beyond the horizontal footprint of the keyboard platform. The grips serve to cushion the keyboard platform, thereby reducing scraping against other items as well as reducing noise during operation.

The storage compartments include a front face 19 defining a largely vertical wall, with horizontal ridges 21 extending forward from the wall. The rear edge of the keyboard platform is adapted to be placed in groves formed by these ridges, thereby providing different angles with respect to the horizontal of the support tray. In the embodiment shown these angles range from neutral angle to a negative 7°, although in one embodiment the tray is fixed at negative 7°. At approximately the midpoint of the keyboard platform is a platform aperture 39, and along the back edge approximately midway along the keyboard platform is a platform notch 37. The aperture 39 and notch 37 provide easy grip areas to allow a user to modify the angle at which the keyboard platform rests. In addition, a notch in the rear of the support tray allows wiring associated with a keyboard to be easily passed to a computer unit.

The keyboard tray is extendably mounted to the underside of a desk. This is done using drawer slides 25 of which only one is shown in FIG. 1. As illustrated, the drawer slide is of a side-by-side type, and in one embodiment is of a type described in U.S. patent application Ser. No. 09/267,425 entitled Slide Detent Device, now U.S. Pat. No. 6,145,944, the disclosure of which is incorporated by reference. This type of slide provides a detent mechanism at both full extension and three quarters extension of the slide. This provides a stable typing environment when the slide is either fully extended, with the storage compartments exposed, or when the slide is partially extended, with the storage compartment not exposed. Other types of drawer slides, however, such as telescopic drawer slides, could be used. L-shaped brackets 27*a, b* are mounted to the drawer slides. The L-shaped brackets are attached to a planar web 29 of one of the drawer slides via welding or other means. The brackets extend vertically, thereby forming a vertical surface 31, from the web of a drawer slide, and then have a roughly 90° bend to form a horizontal surface 33 extending from the slide member. The horizontal surface of the brackets allows the brackets to be easily mounted to the bottom of a desk or other flat table-like surface. The vertical surface is attached to the slides in one embodiment by screws, passing through apertures 35 in the vertical surface. The vertical surface includes a plurality of apertures at different heights, thereby allowing for height adjustment of the unit.

When the slides are retracted, and the keyboard tray is located under the flat surface, the shrouds 23 would necessarily contact the L-shaped brackets. Accordingly, the shrouds include a slot 39*a, b* in the upper surface of the shroud to allow for passage of the brackets when the keyboard tray is retracted. When the keyboard tray is extended, however, the shrouds provide a way of keeping dust and other foreign objects, including fingers, etc., away from the slide members.

The shrouds also include a horizontal surface 41 extending inwards towards the rear of the shroud. This horizontal surface has two knobs, or protrusions, 43*a, b* extending vertically. The knobs or protrusions provide a convenient way of keeping keyboard cords, mouse cords, or the like in a neat and orderly fashion, and away from the keyboard surface. Moreover, the protrusions are spaced apart a distance such that many common mouse cords are firmly held in place when placed between the protrusions. In other words, in one embodiment the protrusions provide a "snap-fit" engagement for the mouse cords.

The palmrest is formed of a gel-like substance. In other embodiments, a foam material is used in place of the gel-like substance.

The storage compartment 17 actually comprises three separate removable replaceable storage compartments in the embodiment illustrated. A left storage compartment 45 includes a roughly half cylindrical indentation 47 for containing pencils and the like. A right storage compartment 49 has a rectangular storage area 51 with an opening in front. This allows for convenient placement of floppy disks, CD-ROMs and other similar flat items. The rectangular storage area has a slight negative slope, namely sloping away from the keyboard support surface, this helps avoid dislodgement of items in the storage compartment as the keyboard tray is opened and closed, as well as providing for an easier way of grabbing the items in the tray. A middle storage compartment 53, located between the left and right storage compartments, includes a rectangular storage area 55 for note pads, business cards, and the like, as well as a small semi-cylindrical area for small items. All of the storage compartments have ridges extending across their front face in a horizontal manner so as to allow for placement of the keyboard support platform at various angles of orientation.

Figure 2:
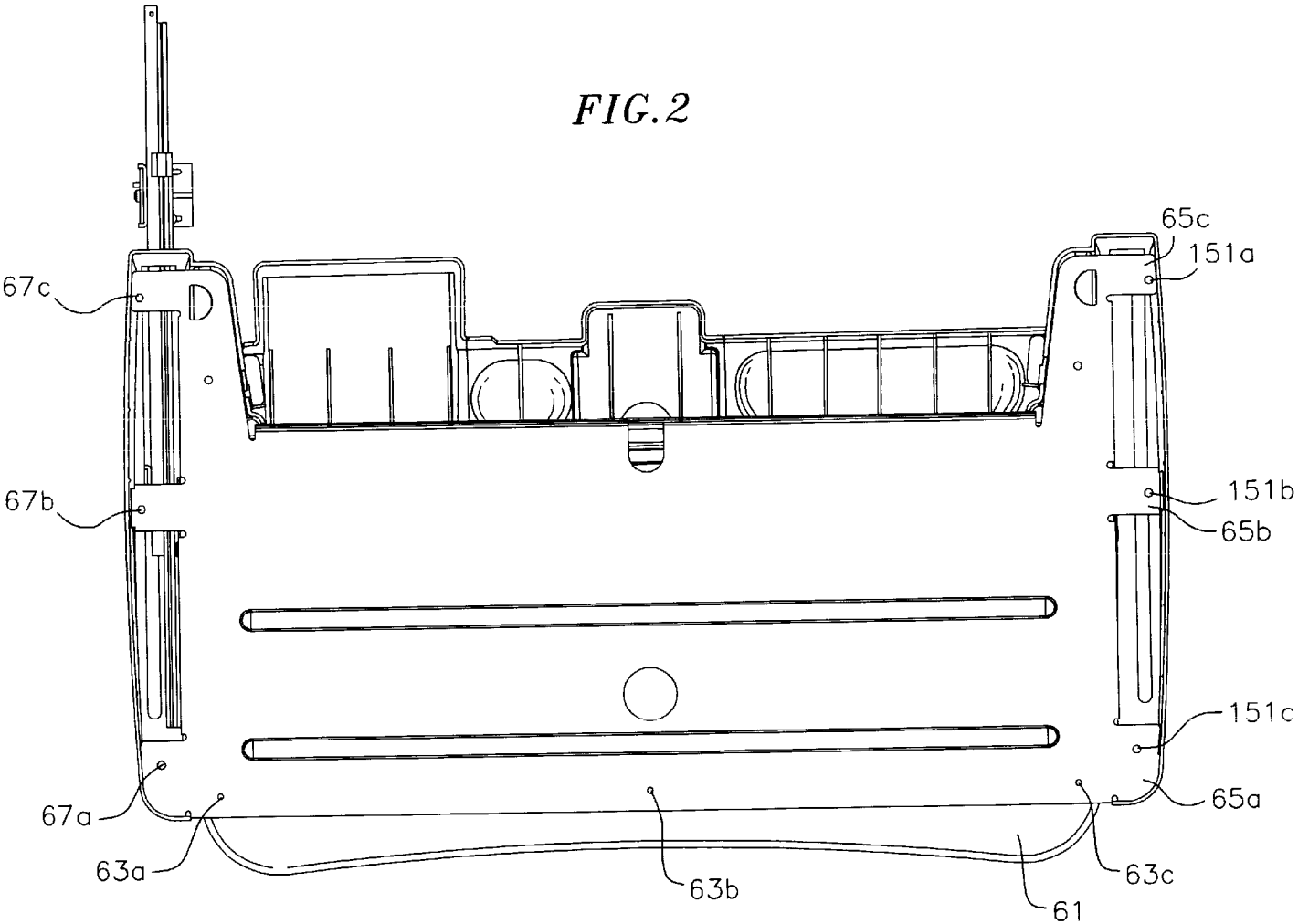
FIG. 2 is a bottom view of the keyboard tray of FIG. 1.

Turning now to FIG. 2, the underside of the keyboard tray of FIG. 1 is illustrated. FIG. 2 illustrates some of the mounting interrelationships between the components which make up the pull-out keyboard tray. The bottom most surface of the keyboard tray is provided by the support tray 11. The palmrest 15, which is mounted to a rigid surface, i.e., a board 61 for support, is mounted on top of the support tray and extends forward of the support tray. Three apertures 63*a, b, c* are placed near the forward edge of the support tray, with one in the middle and one near either edge, to allow for a screw, rivet, or other mechanism for removably mounting the palmrest and rigid surface to the support tray. In one embodiment, a screw is placed through the aperture and the rigid surface, and into the palmrest. The head of the screws include T-nuts, or alternatively wings, to increase the ease of manually replacing or removing the palmrest. This is useful, for example, when use of a keyboard including a palmrest, or merely an oversize keyboard, is desired, as well as when a different palmrest is desired.

The storage compartments extend beyond the rear edge of the support tray. As will be described in more detail later, the storage compartments have a slot adapted to receive an upturned edge of the rear edge of the support tray, with the storage compartments thereby forming an overhanging structure.

Each of the sides of the support tray have three planar extending members 65*a, b, c*, and 67*a, b, c*. The planar extending members are located at the front, the middle, and the rear of the sides of the keyboard support tray. The planar members have apertures for receiving a screw or other cylindrical attachment means. The apertures are positioned so as to allow the screw or other attachment means to engage in receptors on the shrouds, thereby allowing mounting of the shrouds to the support tray.

Figure 19:
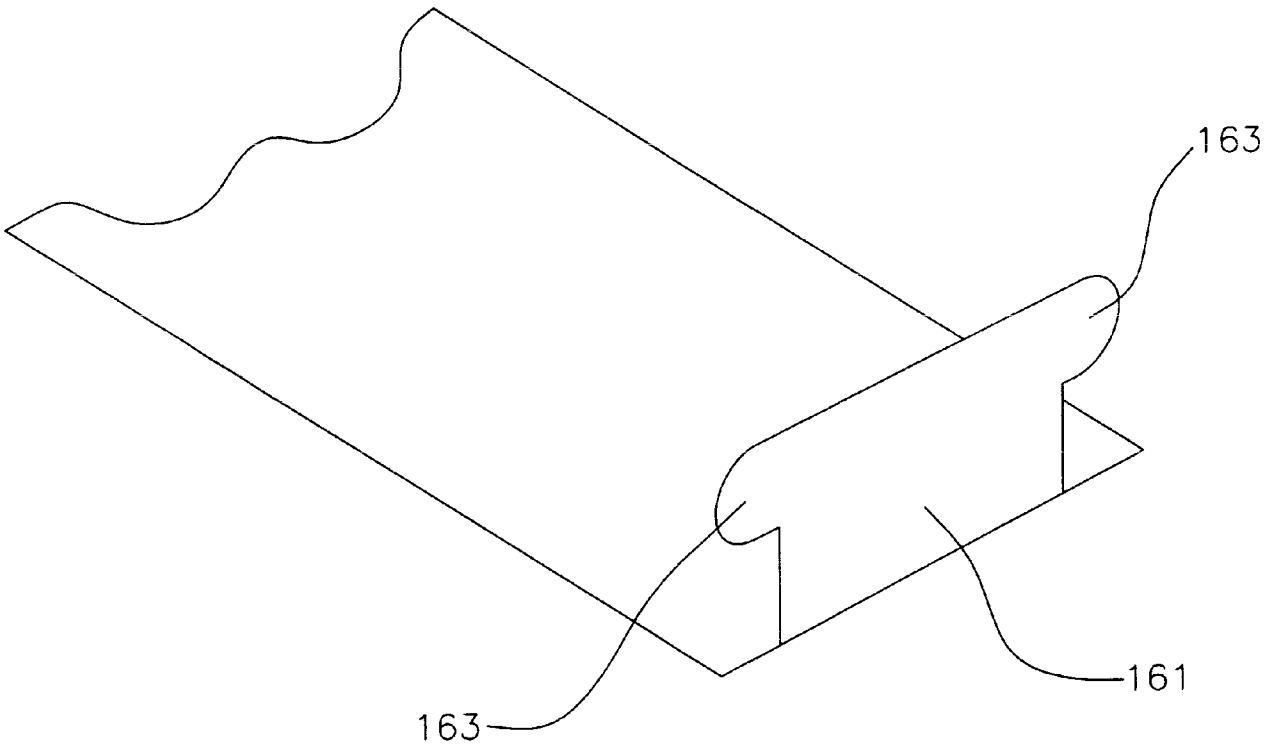
FIG. 19 is a view of an upturned tab on the support tray adapted to engage the slide shroud.
Figure 20:
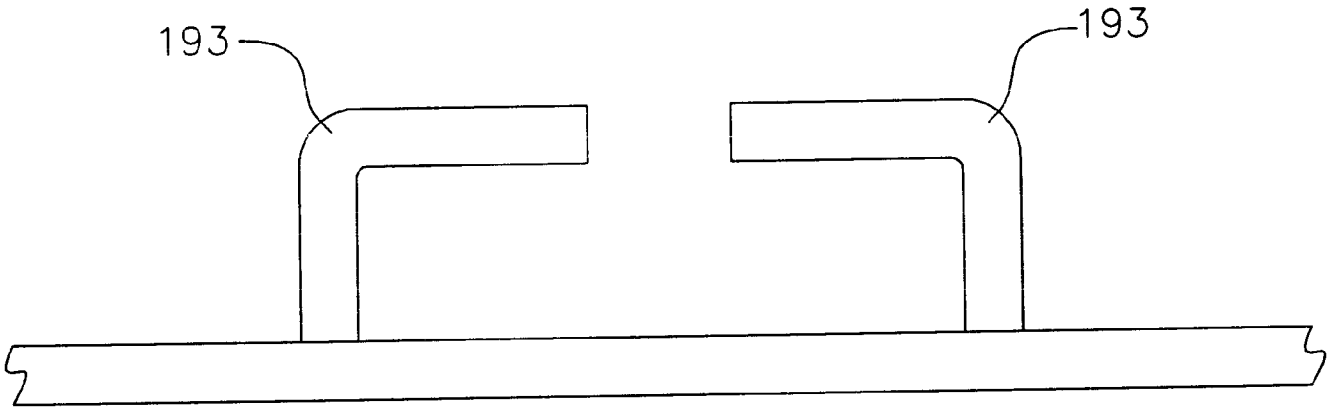
FIG. 20 is a view of the slide shroud including a bracket adapted to engage the upturned tab.

In one embodiment the middle planar extending member has an upturned tab which engages a bracket formed in the slide shroud. The upturned tab of the middle planar extending member is illustrated in FIG. 19. The bracket formed in the slide shroud is illustrated in FIG. 20. The upturned tab is largely an upturned edge 161 of the end of the middle planar extending member. The tab has a width less than that of the middle planar extending member, but also has a top surface of a slightly greater width which forms barbs 163. These barbs are adapted to contact and frictionally engage sides of the bracket formed in the slide shroud. In an alternative embodiment the upturned tab does not have barbs, but is instead sized for a slight interference fit with the bracket.

The bracket in the slide shroud is integrally formed with the slide shroud, and comprises opposing L-shaped pieces on the inner surface of the slide shroud. The L-shaped pieces 191, 193 are spaced apart a distance slightly less than the width of the barbs on the upturned tab in the described embodiment. Also in the embodiment described, the L-shaped pieces are centered about the position of the mid-shroud mounting post of FIG. 8, and the mid-shroud mounting post is not present.

Figure 3:
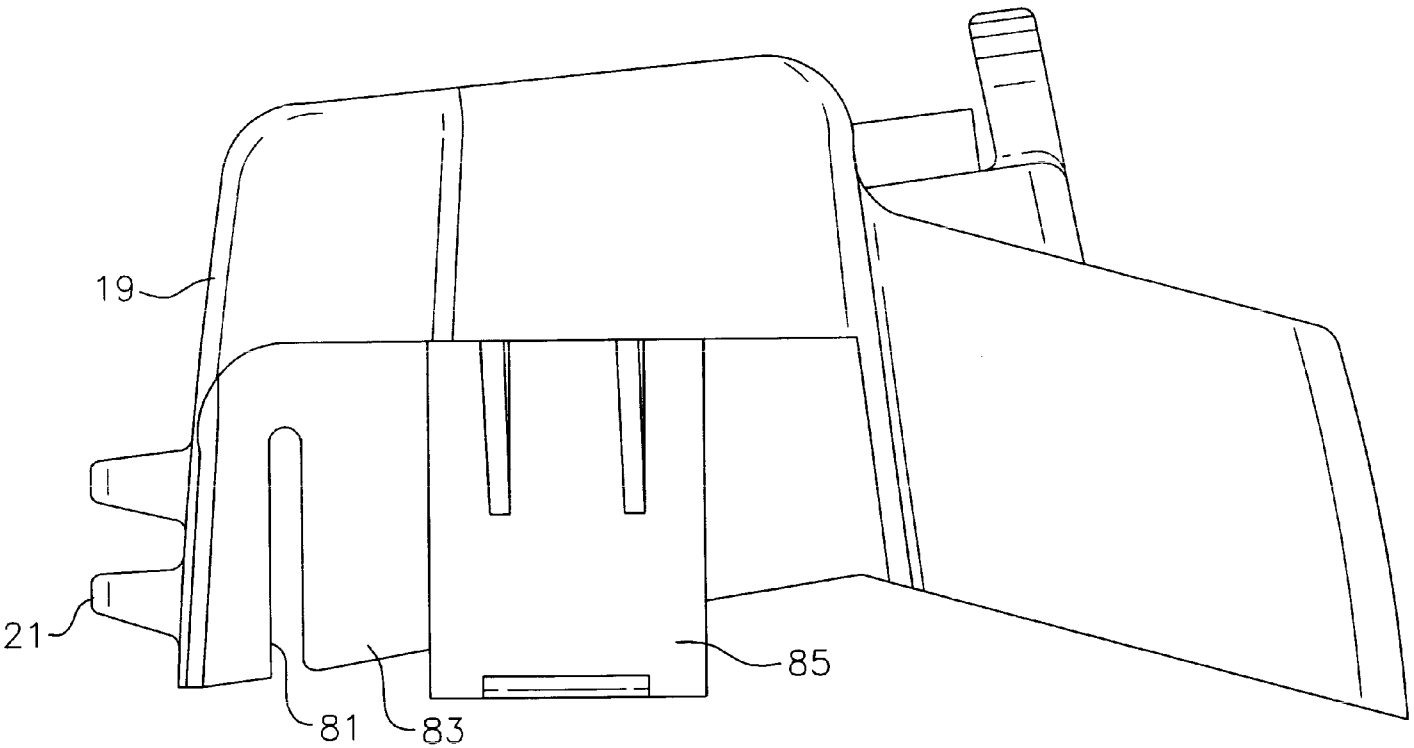
FIG. 3 is a side view of the storage compartment of a keyboard tray of FIG. 1.

FIG. 3 illustrates a side view of the right storage compartment, and in particular the ridges extending from the front of the storage compartment adapted for engagement with the keyboard platform. The front wall of the storage compartment slopes slightly away from the keyboard area. Near the bottom of the front wall are two longitudinal ridges with upper surfaces. These upper surfaces allow the keyboard platform to be rested on the upper surfaces. Thus, the keyboard platform may be placed on top of the upper surface thereby allowing the keyboard platform to have a neutral incline. Placing the keyboard platform between the two ridges, whereby the keyboard platform is placed on top of the flat surface of the lower ridge, allows the keyboard to be placed at a slight negative incline. Further, the keyboard platform may be laid on top of the keyboard support tray, which allows for the keyboard platform to be placed at three varying angles.

FIG. 3 also illustrates the slot 81 provided to receive the upturned edge of the support tray. The slot is in a plurality of webs 83 provided within the underside of the storage compartment. This slot is, or as previously stated, is towards the front of the storage compartment. In addition, FIG. 3 illustrates a semi-hooked strut 85 which positions the storage compartment with respect to the shroud.

Figure 4:
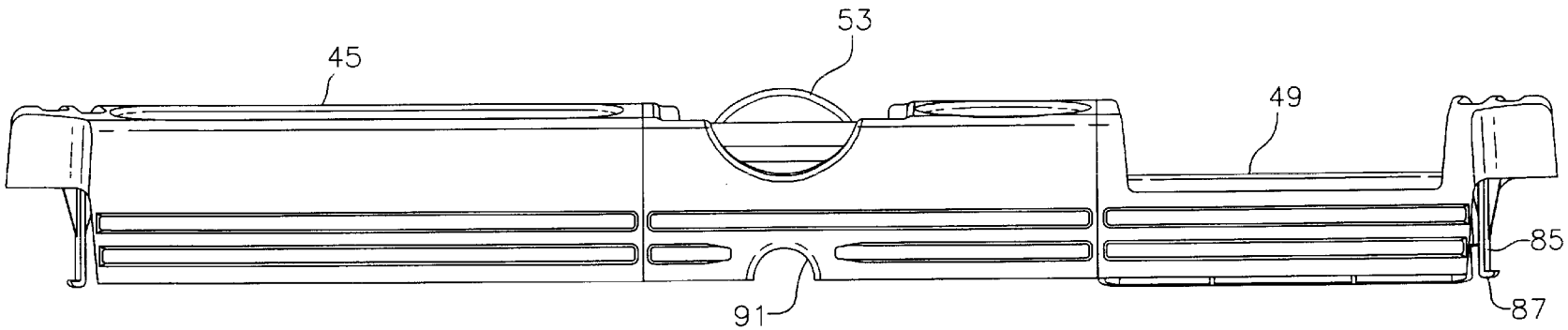
FIG. 4 is a front view of the storage compartments of the keyboard tray of FIG. 1.

FIG. 4 is a front view of the storage compartments. The front view shows the left compartment 45, the middle compartment 53, and the right compartment 49. The front view also shows a portion of the strut with the hooked tab 87 on the right side of the right storage compartment. The left storage compartment has a corresponding left strut having a hooked tab. The middle storage compartment has a semi-circular notch 91 in the lower front portion of the compartment so as to allow passage of electrical cords such as a keyboard cable.

The front view also illustrates the ridges extending along the lower front surface of the storage compartments. Each ridge is collinear with the corresponding ridges on the other storage compartments, thereby providing for level side-to-side displacement of the keyboard support tray.

Figure 5:
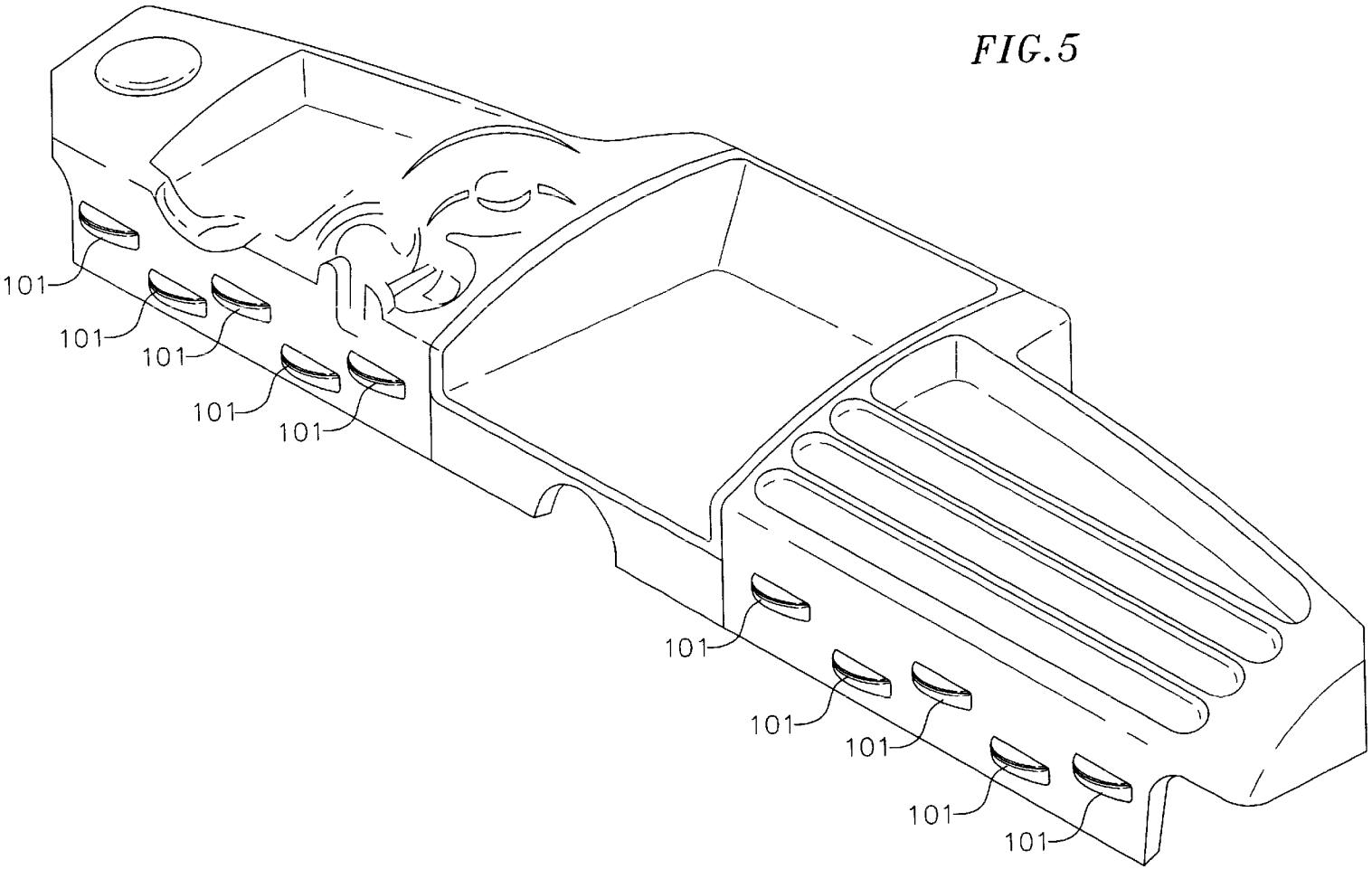
FIG. 5 is an alternate embodiment of a unitarily formed storage compartment for a keyboard tray.

FIG. 5 illustrates an alternative embodiment of a unitarily formed storage compartment. The unitarily formed storage compartment takes the place of the left, middle, and right storage compartments. The unitarily formed storage compartment also does not contain ridges as described with respect to the left, right, and middle storage compartments. Instead, the unitarily formed storage compartment has a plurality of semi-circular disks 101 protruding from the front service. The semi-circular disks are arranged in two horizontal lines so as to provide the keyboard holding angles as previously described.

Figure 6:
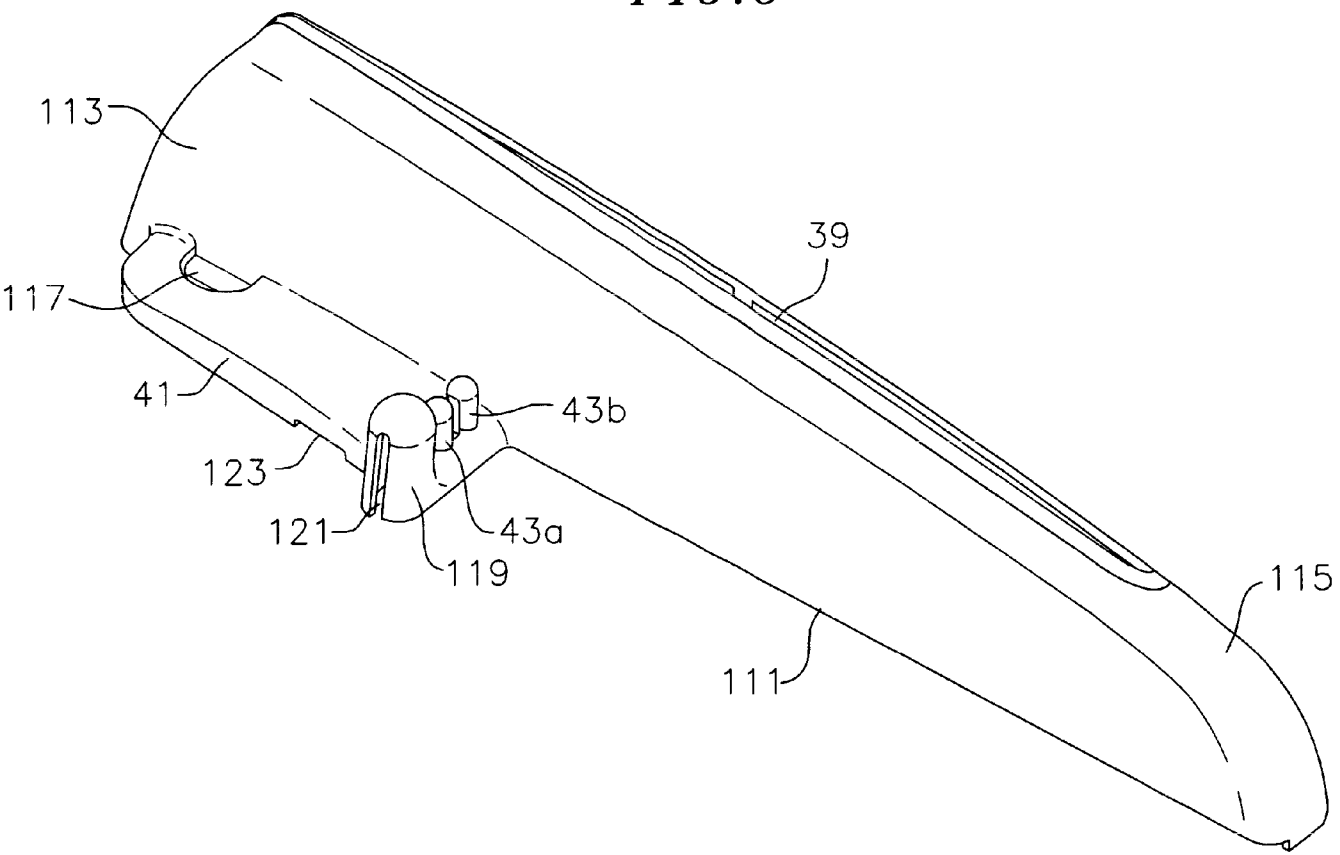
FIG. 6 is a planar view of a right slide shroud of the keyboard tray of FIG. 1.

FIG. 6 illustrates the right slide shroud. The right slide shroud includes a shroud body 111. The shroud body has an elongated upper beak-like shape. This beak-like shape includes an elongated length, a relatively narrow width, a steeply sloping back surface 113, and a relatively steeply sloping front surface 115. The height of the body decreases slightly from the rear forward. The rear of the shroud body (not shown) is substantially open to allow passage of a slide. In addition, the top of the shroud body includes the slot 39 to allow passage of the L-brackets mounting the slides to the underside of a desk or other surface.

A platform 41 extends from the rear lower inner surface of the body. The planar surface, which is approximately the width of the shroud body, includes an aperture 117 towards the rear of the surface to allow passage of a keyboard cord, mouse cord, or the like. More particularly, the aperture allows access to mounting locations on 34 extension slides. The front of the planar surface includes two protrusions 43*a, b* located side-by-side approximate the front of the planar surface. The protrusions provide a handy means for routing of cords, as well as means to wrap the cords so as to maintain the cords in a constant position. The planar surface also includes an attachment protrusion 119 on the forward inner edge of the planar surface. The attachment protrusion has a vertical slit 121 adapted to receive the upturned edge of the keyboard support tray. The planar surface also includes a rectangular cut-out 123 on the lower surface of the inward edge. The rectangular cut-out is adapted to receive the semi-hooked end of the strut on the storage compartment. The rectangular cut-out thereby provides additional positional stability for the storage compartments.

Figure 7:
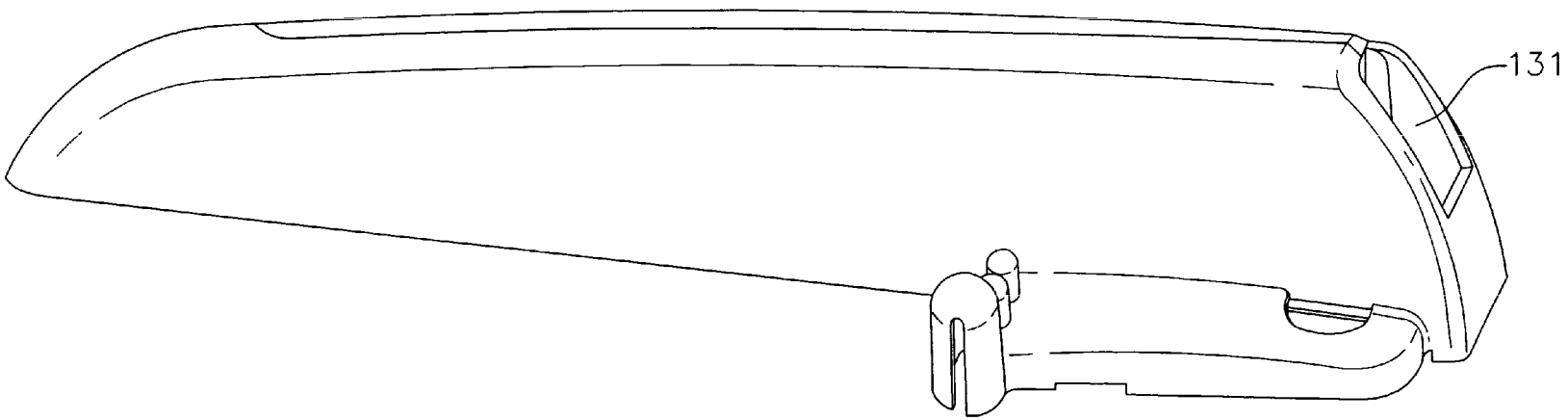
FIG. 7 is a planar view of a left slide shroud of the keyboard tray of FIG. 1.

FIG. 7 illustrates a view of the left slide shroud. The left slide shroud is a mirror image of the right slide shroud. The view illustrated in FIG. 7, however, illustrates additional detail regarding the rear end of the shroud. As illustrated, the rear end of the shroud body includes a rectangular aperture 131 extending substantially across the width of the body, and over roughly the top half of the rear end of the body.

Figure 8:
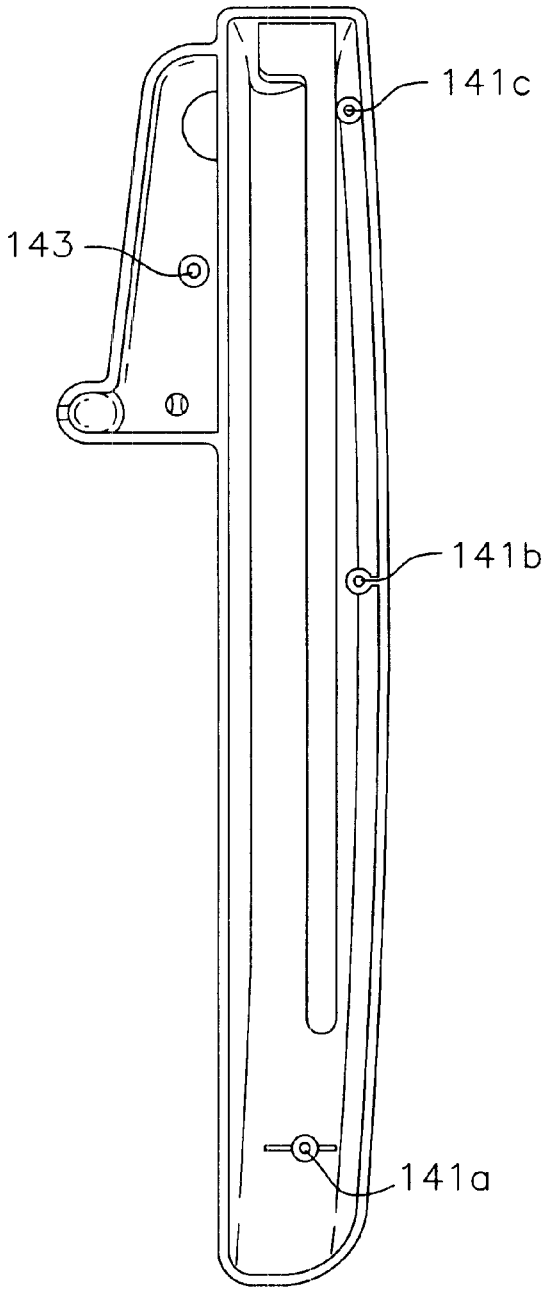
FIG. 8 is a bottom view of the slide shroud of FIG. 7.

FIG. 8 illustrates a bottom view of the slide shroud of FIG. 7. As shown in the bottom view, the slide shroud is substantially hollow. Three posts 141*a, b, c,* however, extend from the inside surface of the shroud body perpendicularly downward. The posts include cylindrical hollowed out portions adapted to receive a screw and the like. One cylindrical mounting post is located approximately at the midpoint at the width of the shroud body near the forward edge of the shroud body. Two other mounting posts are located along the inside outer edge of the shroud body, one approximately at midpoint and one near the rear end. To increase rotational stability, a fourth mounting post 143 is located approximately the midpoint of the planar surface.

Returning now to FIG. 2, illustrating the underside of the keyboard tray, it may be seen that the support tray includes screw hole midpoints 151*a, b, c* corresponding to those where a cylindrical mounting post contact the support tray. Thus, the support tray supports the slide shroud, while the mounting screws prevent extraneous motion.

Figure 9:
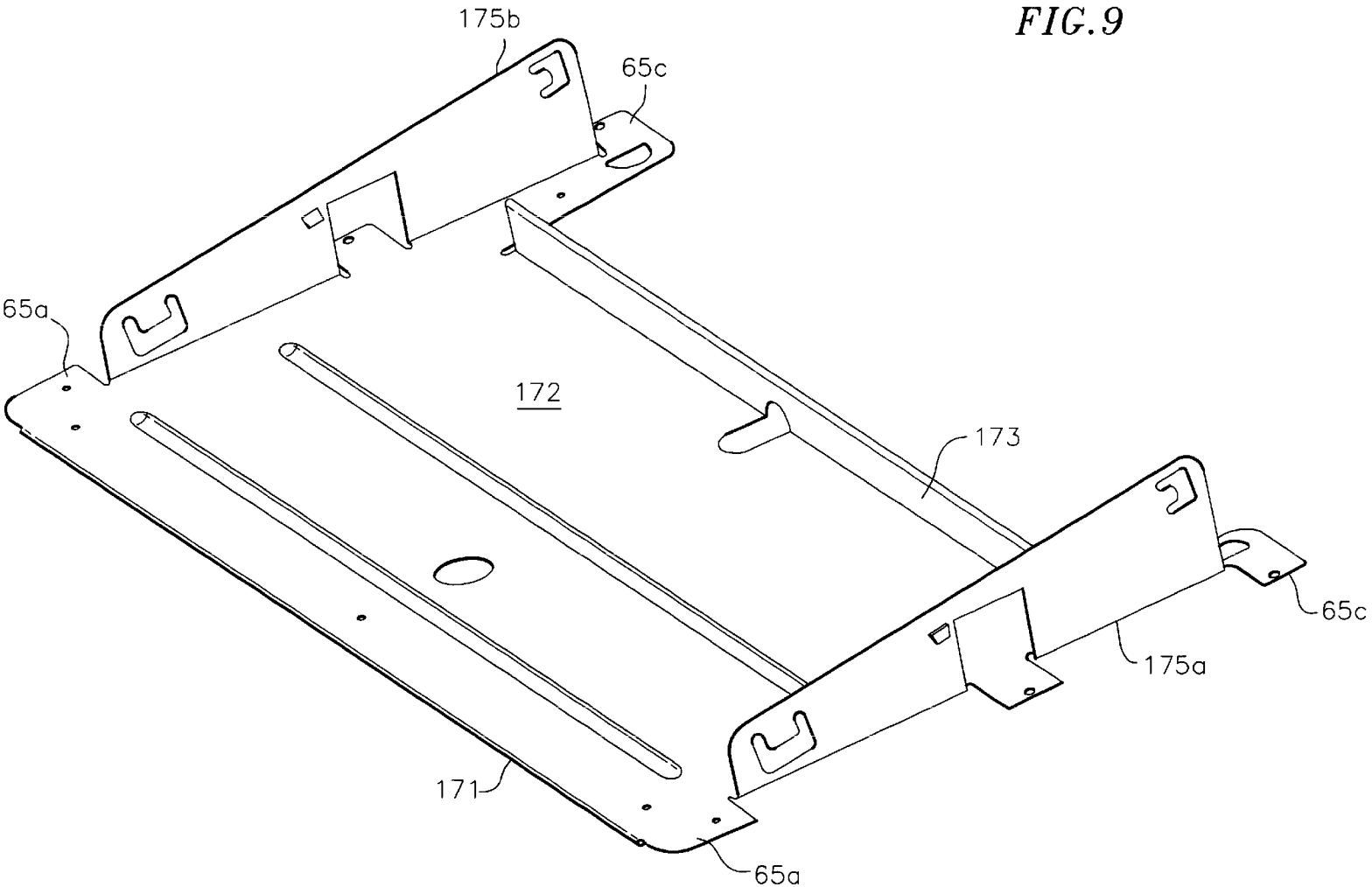
FIG. 9 is a planar view of a support tray of the keyboard tray of FIG. 1.

FIG. 9 illustrates the support tray. In one embodiment no keyboard platform is used. Instead a keyboard rests directly on the support tray. In addition, in one embodiment no storage compartments are used.

The support tray has a largely rectangular flat surface 172. Three planar surfaces extend from the left and right side of the flat surface. The forward most planar surfaces 65*a* form part of the front edge of the support. The front end of the support generally has a rolled up edge 171. The rear of the support tray includes an upturned edge 173. Also extending from either side of the rear of the support tray, and in a rearward direction, are wings 65*c*. The wings are substantially flat and are essentially merely a continuation of the rectangular flat surface.

Along either side of the flat surface are support walls 175*a, b*. The support walls extend from the rear edge of the forward planar surface and extend to the forward edge of the rearward planar surface. The side walls are adapted to be coupled to the slide members. The planar surfaces, as previously mentioned, are adapted to mount the slide shrouds. In addition, when mounted the slide shrouds largely encompass the support walls.

The flat surface also has apertures corresponding to the location of the apertures in the keyboard platform. This increases the ease of moving the angle at which the keyboard tray rests as well as providing keyboard cable access holes.

Figure 10:
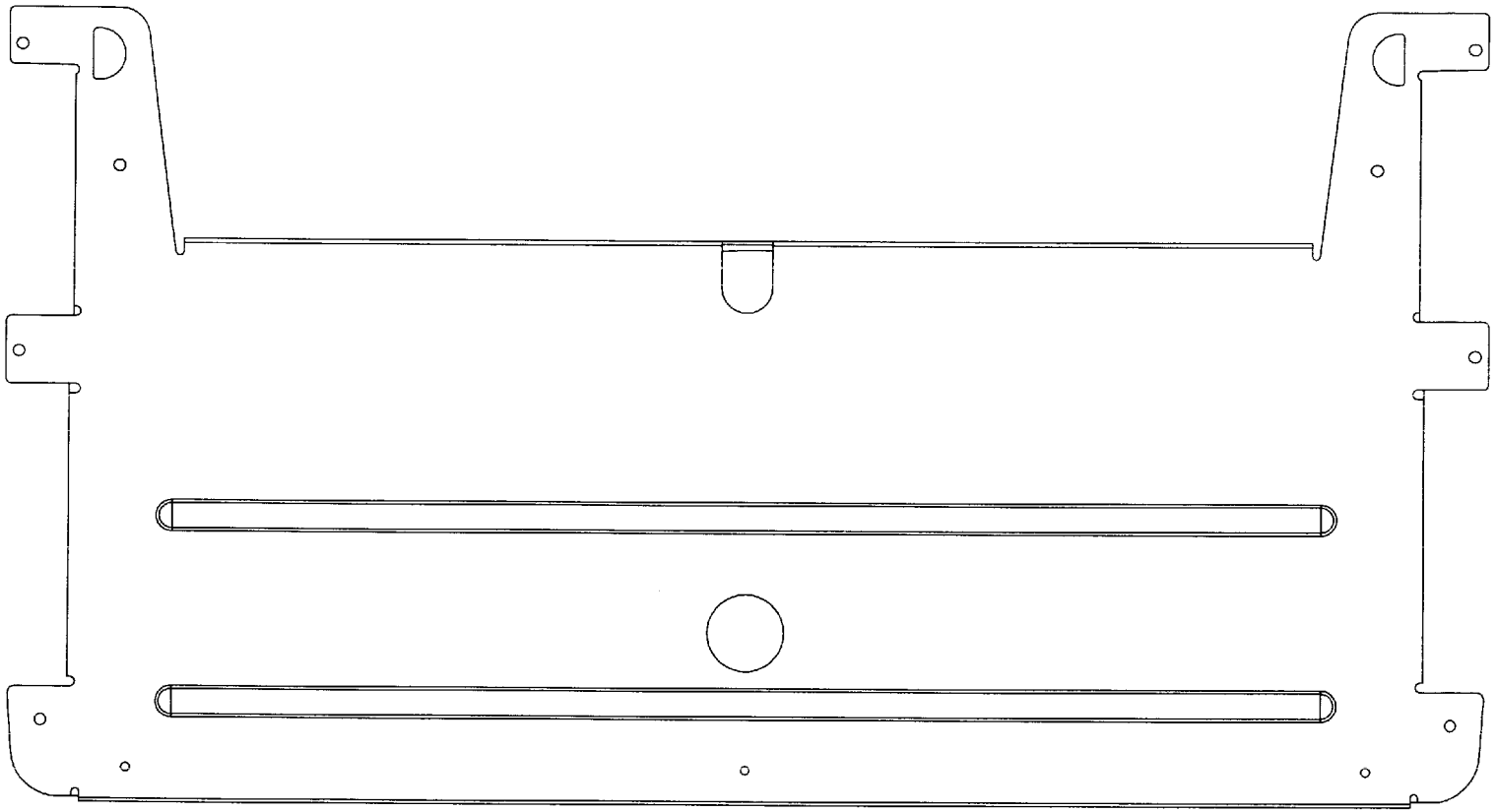
FIG. 10 is a bottom view of the support tray of FIG. 9.

FIG. 10 illustrates a bottom view of the support tray. The bottom view more fully shows the relationship of the wings and the flat surface. The bottom view also more completely illustrates the apertures along the front edge, the extensions, and the details of the support tray for mounting of the slide shrouds and palmrests.

Figure 11:
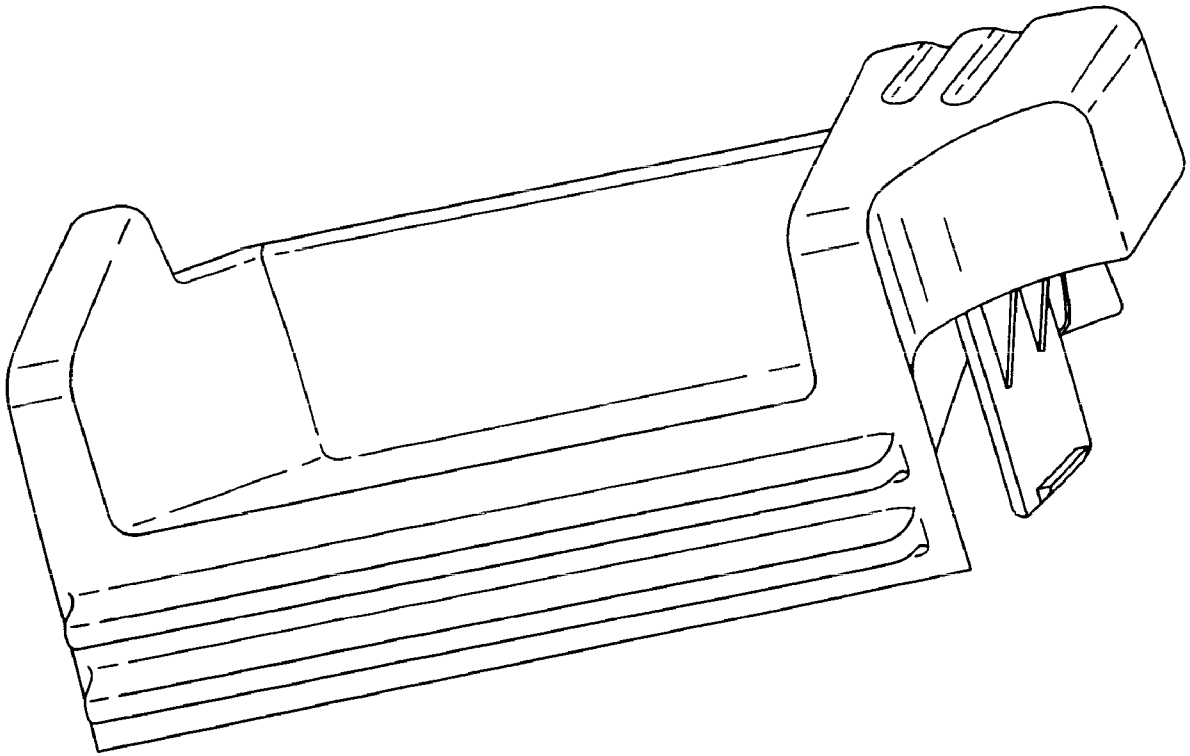
FIG. 11 is a perspective view of a right storage compartment of the keyboard tray of FIG. 1.

FIG. 11 is a perspective view of the right storage compartment. FIG. 11 shows the ridges for supporting the keyboard tray, the storage area, and the strut with hooked end for attachment to the slide shrouds.

Figure 12:
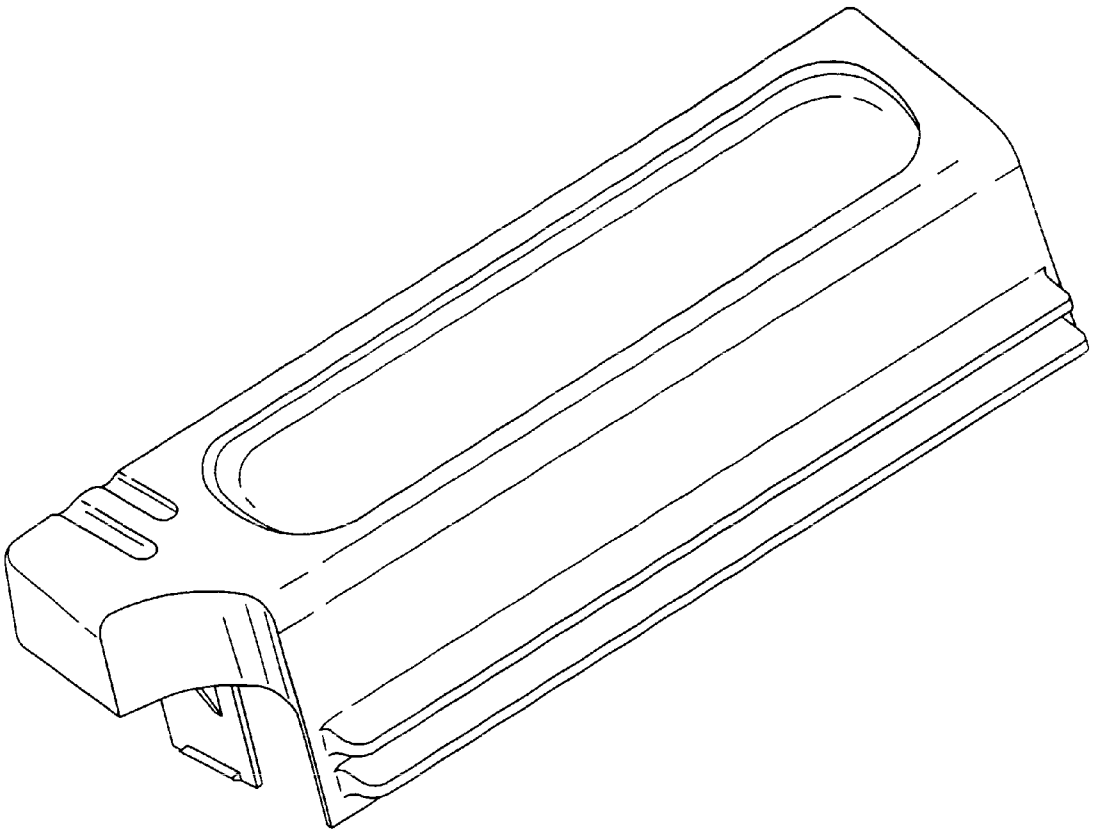
FIG. 12 is a perspective view of a left storage compartment of the keyboard tray of FIG. 1.

FIG. 12 shows details of the left storage compartment. As with the right storage compartment, the left storage compartment includes ridges for placing the keyboard tray at different angles, a storage area, and a strut with a hooked end. The strut of the left side storage compartment is, of course, essentially the mirror image of the strut of the right storage compartment.

Figure 13:
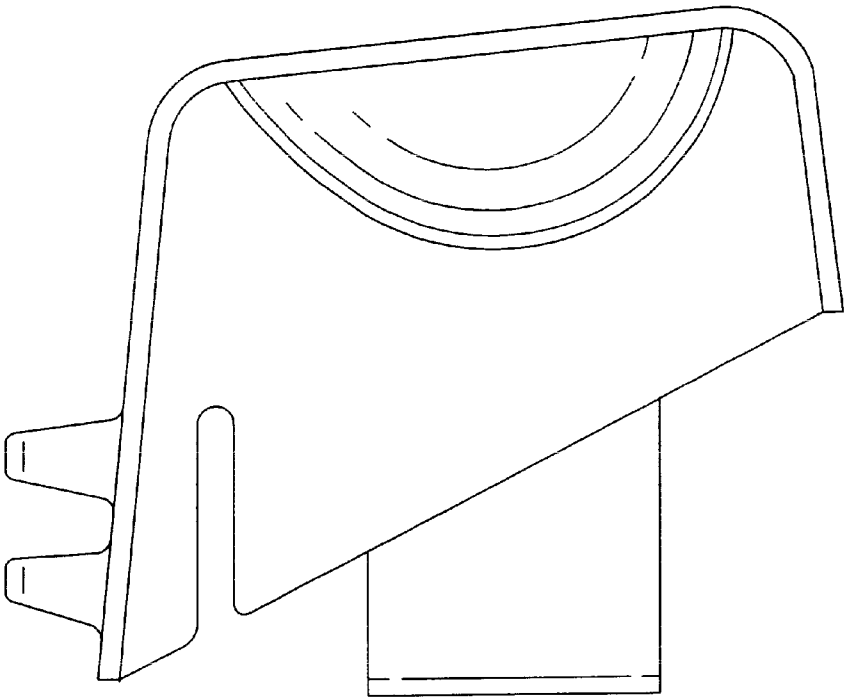
FIG. 13 illustrates a side view of the storage compartment of FIG. 11.

FIG. 13 illustrates a side view of the storage compartment of FIG. 12. The side view more fully illustrates the slits adapted to receive the upturned edge of the support tray. These slits are placed in transverse webs undergirding the storage compartment, and which provide additional support for the storage compartment.

Figure 14:
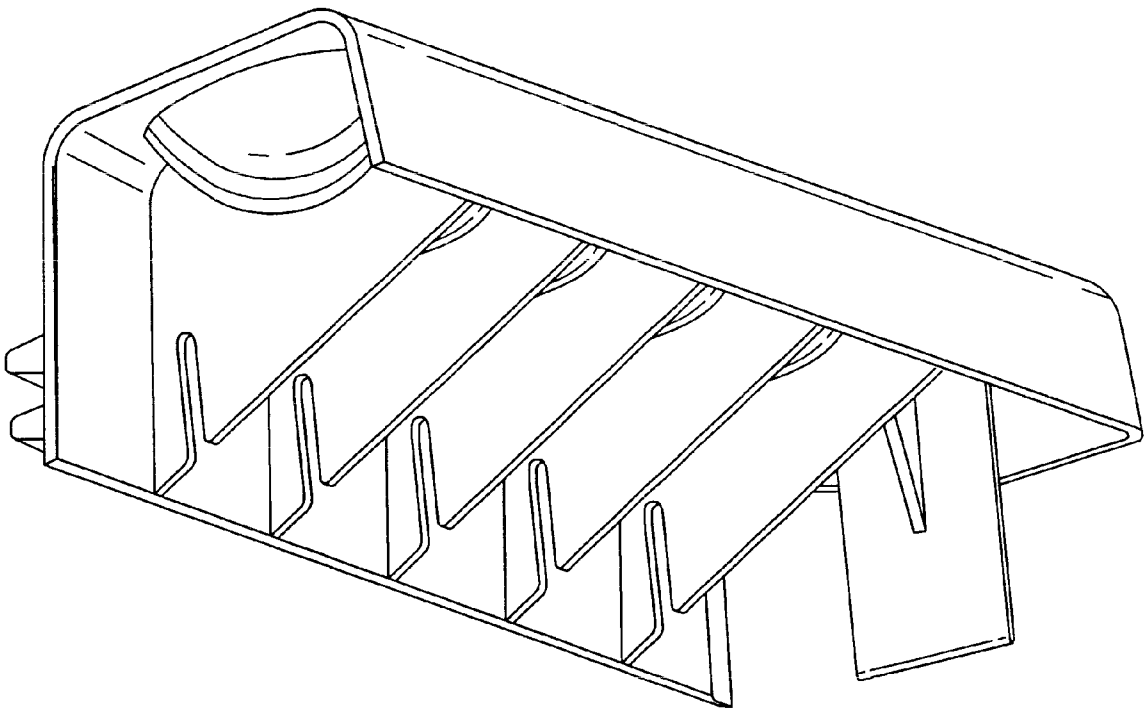
FIG. 14 illustrates the underside of the storage compartment of FIG. 11.

FIG. 14 more fully illustrates the transverse webs of the right storage compartment. The right storage compartment includes five webs, each with a vertical slot. The plurality of webs with vertical slots provides additional stability both to the storage itself and for positional stability with respect to the keyboard support tray.

Figure 15:
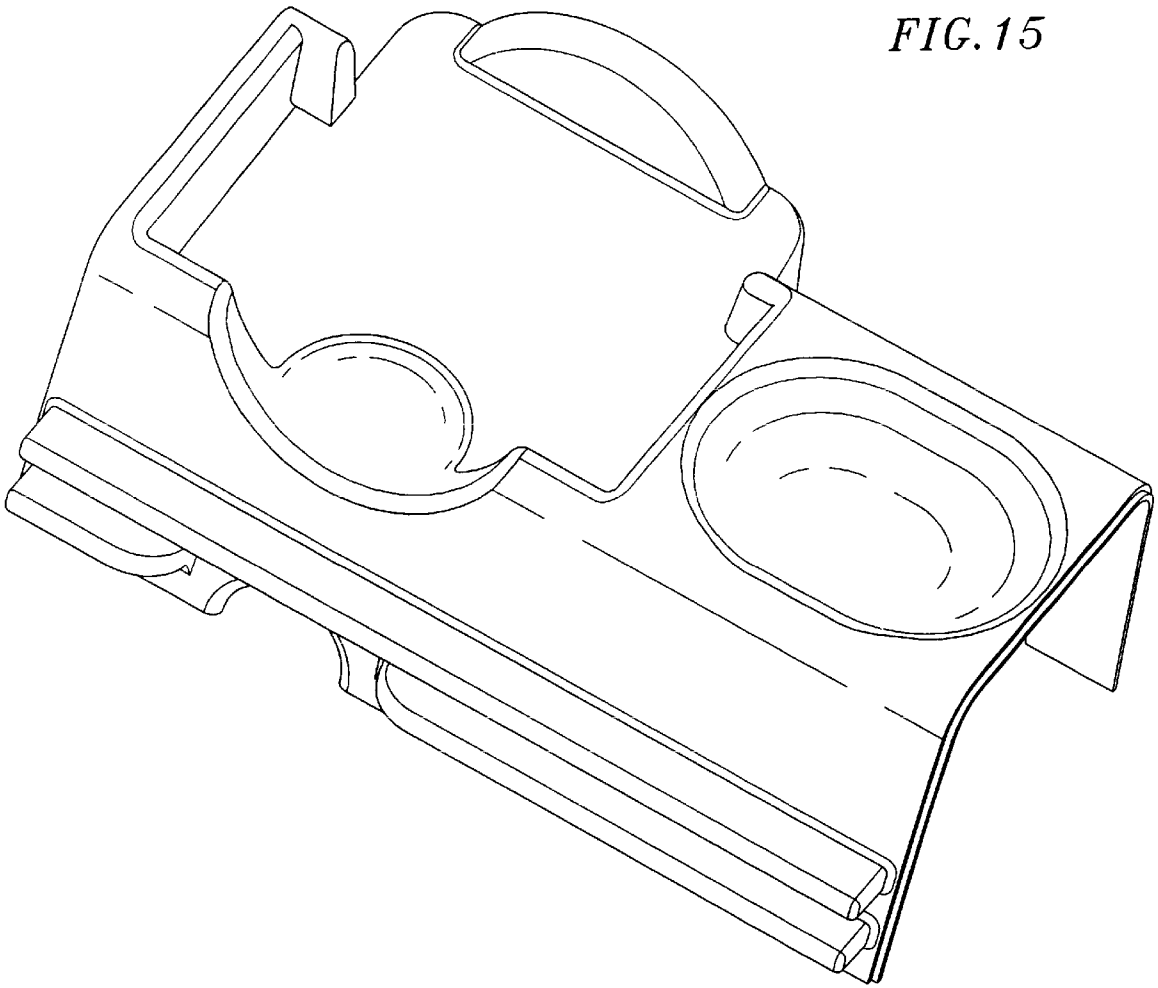
FIG. 15 is a perspective view of a middle storage compartment of the keyboard tray of FIG. 1.

FIG. 15 illustrates the middle storage compartment. The middle storage compartment is adapted to abut the right storage compartment on one side and the left storage compartment on the other side. The middle storage compartment includes an oval indented area on the top for storage of small items such as paper clips and the like. Also on the top of the middle storage compartment is a rectangular storage area for storage of note pads and the like. The front edge of the middle storage compartment includes two ridges adapted for placing the keyboard platform thereon. Along the bottom front edge of the middle storage compartment is an oval cut-out which increases the ease of removing the middle storage compartment without disturbing the left or right storage compartments.

Figure 16:
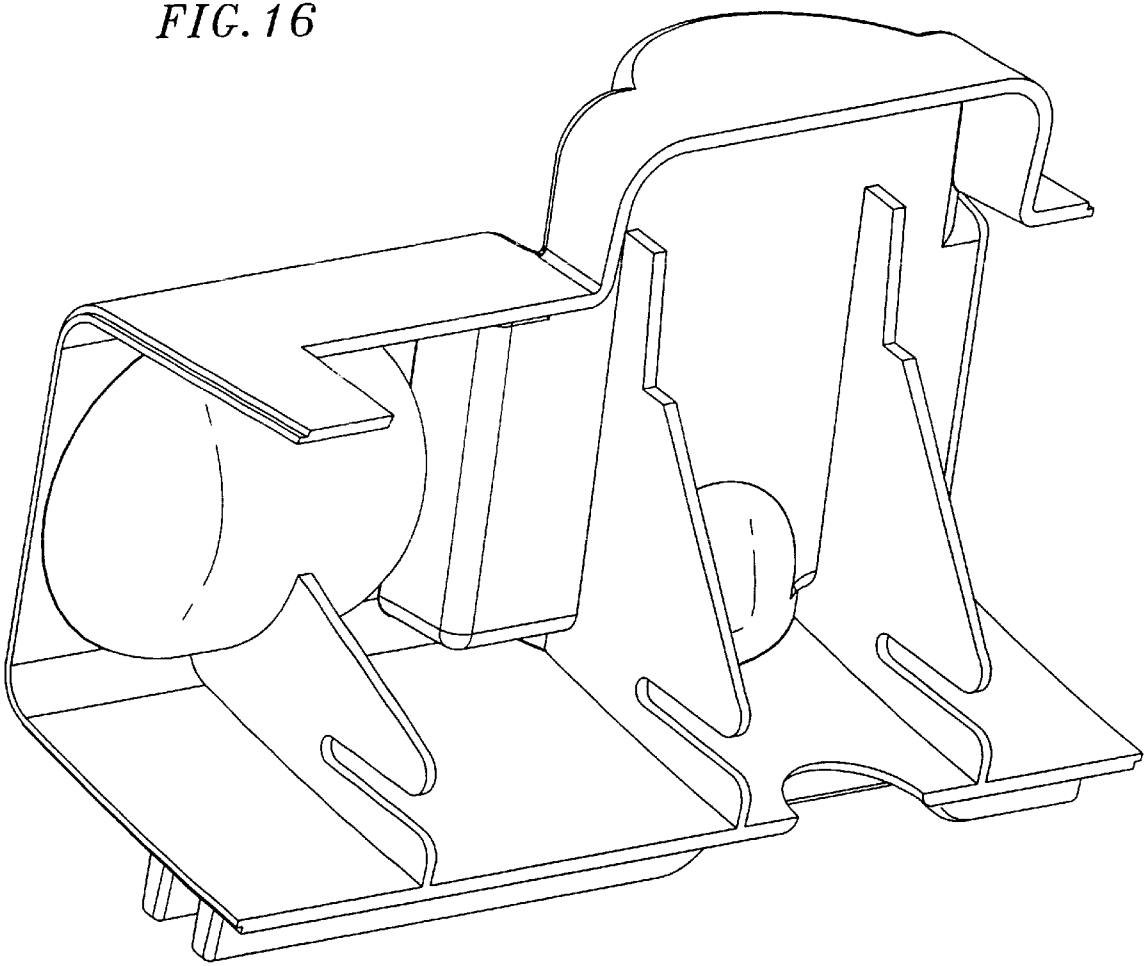
FIG. 16 is a bottom view of the storage compartment of FIG. 14.

FIG. 16 illustrates the underside of the middle storage compartment. As with the other storage compartments, the middle storage compartment has transverse webs undergirding the storage compartment. The transverse webs include slits adapted to receive the upturned edge of the support tray.

Figure 17:
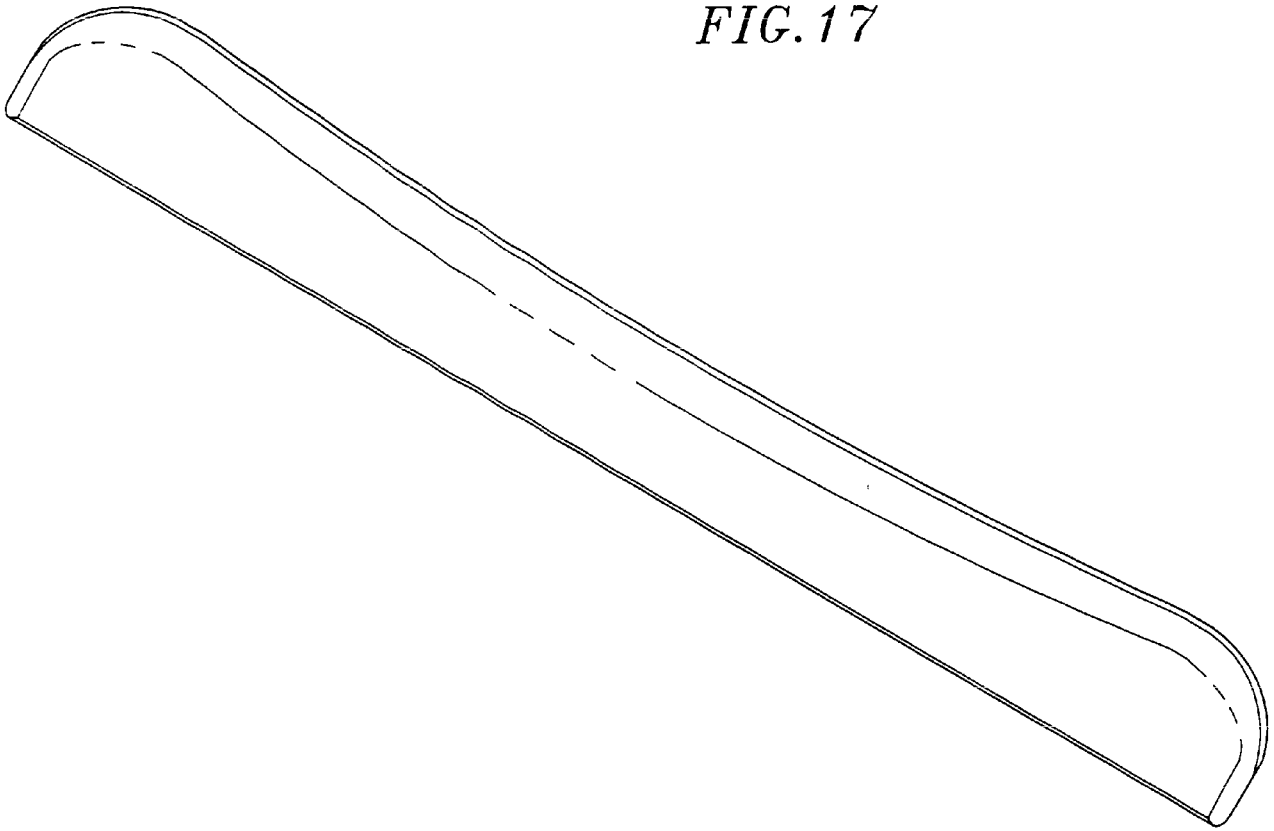
FIG. 17 is an isometric view of a wooden support pad assembled with the palmrest of the keyboard tray of FIG. 1.

FIG. 17 illustrates a bottom view of the palmrest and board. The palmrest and support board form a large planar surface with a flat edge adjacent a keyboard when mounted to the support tray, and a column cave rounded edge facing the user. The board is placed in a cut-out region of the palmrest, and the board includes three mounting apertures. In one embodiment the palmrest and board are together largely covered in material, thereby forming the palmrest and board into an integral assembly and largely hiding the wood or plastic base from view.

Figure 18:
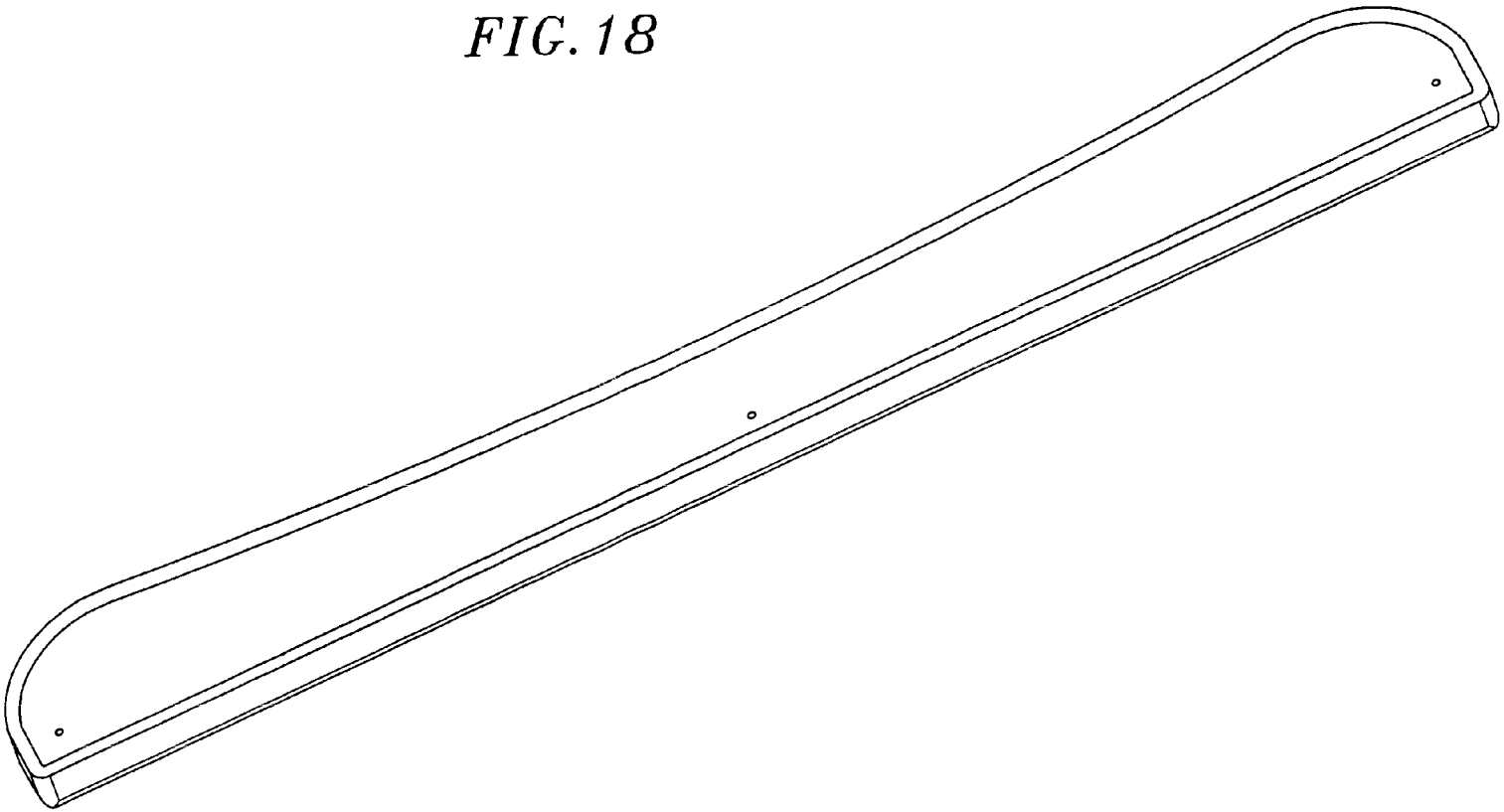
FIG. 18 is a view of a bottom side of the palmrest of the keyboard tray of FIG. 1.

FIG. 18 illustrates a view of the bottom side of the palmrest, including a cut-out adapted to receive the board. The bottom side of the palmrest also includes three cavities corresponding in size and location to the apertures in the board.

Thus, the present invention provides a device with many small features for increasing the ease of use in keyboards for computer systems in modern day office furniture. Although this invention has been described in certain specific embodiments, it should be understood that the invention may be practiced otherwise than as described. Accordingly, the described embodiments should be viewed as illustrative and not restrictive, the scope of the invention to be determined by the claims, and their equivalents, supported by this application.

What is claimed is:

1. A pullout keyboard tray assembly slidably extendable from a position substantially below a desktop surface to a position extending out from the desktop surface, the pullout keyboard tray comprising:

a keyboard platform adapted to receive a keyboard, the platform having a forward edge, a rearward edge, and side edges interconnecting the forward and rearward edges;

a support tray bounded in the front by a palmrest and in the rear by a largely vertical wall, wherein said keyboard platform is adapted to be received therebetween on said support tray, the forward edge of the keyboard platform being approximate the palmrest, the largely vertical wall having horizontal edge surfaces adapted to support the rearward edge of the keyboard platform.

2. The pullout keyboard tray assembly of claim 1 wherein the largely vertical wall comprises a forward edge of at least one storage compartment.

3. The pullout keyboard tray assembly of claim 2 wherein the largely vertical wall comprises a forward edge of a plurality of storage compartments.

4. The pullout keyboard tray of claim 1 wherein the horizontal edge surfaces provide the keyboard tray with an adjustable inclination from approximately neutral to approximately negative seven degrees.

5. A pullout keyboard tray assembly comprising:

a pair of slides, each comprising at least two slide members, adapted for mounting to an underside of a desktop, the slides extendable from a retracted position to an extended position;

a keyboard support coupled to the slides;

slide shrouds coupled to the keyboard support, the slide shrouds substantially enclosing portions of the slides adjacent the keyboard support when the slides are in the extended position;

wherein the slide shrouds are mounted adjacent to side edges of the keyboard support and each comprising a substantially elongated body having a cavity enclosing portions of the slides adjacent the keyboard support when the slides are in an extended position, the body having an aperture approximate an end of the body allowing for passage of a one of the pair of slides; and further comprising a bracket coupled to each slide, wherein the slide shrouds each have a slot formed in the elongated body, the slot allowing for the passage of the brackets during extension of the slides.

6. The pullout keyboard tray assembly of claim 5 further including a horizontal surface extending from an edge of the shroud, the horizontal surface having an aperture allowing for the passage of a cord and protrusions adapted to maintain the position of the cord.

7. The pullout keyboard tray assembly of claim 5 wherein the brackets are adapted to couple the slides to the underside of the desktop.

* * * * *

UNITED STATES PATENT AND TRADEMARK OFFICE

CERTIFICATE OF CORRECTION

PATENT NO. : 6,454,369 B1
DATED : September 24, 2002
INVENTOR(S) : Mark J. Cooper et al.

It is certified that error appears in the above-identified patent and that said Letters Patent is hereby corrected as shown below:

Title page,
Item [73], Assignee, delete the comma (,) after "International" to read -- Accuride International Inc. --

Signed and Sealed this

Twenty-eighth Day of September, 2004

JON W. DUDAS
*Director of the United States Patent and Trademark Office*